US007000561B2

(12) United States Patent
Krüger et al.

(10) Patent No.: US 7,000,561 B2
(45) Date of Patent: Feb. 21, 2006

(54) MAST DEVICE FOR A SUBMARINE

(75) Inventors: Lorenz Krüger, Lubeck (DE); Jürgen Spahr, Segeberg (DE); Ulrich Wäntig, Lubeck (DE); Wolfgang Scharf, Horsdorf (DE)

(73) Assignee: Gabler Maschinenbau GmbH, (DE)

( * ) Notice: Subject to any disclaimer, the term of this patent is extended or adjusted under 35 U.S.C. 154(b) by 0 days.

(21) Appl. No.: 10/866,324

(22) Filed: Jun. 10, 2004

(65) Prior Publication Data

US 2005/0279272 A1 Dec. 22, 2005

Related U.S. Application Data

(63) Continuation of application No. 10/176,229, filed on Jun. 20, 2002, now Pat. No. 6,907,839.

(30) Foreign Application Priority Data

Jun. 22, 2001 (DE) ..... 101 29 696

(51) Int. Cl.
*B63G 8/04* (2006.01)
*H01Q 1/34* (2006.01)

(52) U.S. Cl. ..... 114/339; 114/253; 343/709

(58) Field of Classification Search ..... 114/339, 114/340, 242, 244, 253, 254; 343/709, 710, 343/711; 441/21, 23, 24, 27
See application file for complete search history.

(56) References Cited

U.S. PATENT DOCUMENTS

| | | | | |
|---|---|---|---|---|
| 1,746,547 | A * | 2/1930 | McKay | 114/327 |
| 2,273,497 | A | 2/1942 | Moxham | |
| 3,034,471 | A | 5/1962 | Aschinger | |
| 3,073,273 | A | 1/1963 | Raistakka | |
| 3,158,865 | A | 11/1964 | McCorkie | |
| 3,500,429 | A | 3/1970 | Majkrzak et al. | |
| 3,788,255 | A | 1/1974 | Tennyson | |
| 3,972,046 | A | 7/1976 | Lombardi | |
| 3,972,047 | A | 7/1976 | Lombardi | |
| 4,227,479 | A | 10/1980 | Gertler et al. | |
| 4,304,189 | A * | 12/1981 | Wright | 114/254 |
| 4,533,945 | A | 8/1985 | Lauvray et al. | |
| 5,351,639 | A | 10/1994 | Ortelli | |
| 5,447,115 | A | 9/1995 | Moody | |
| 5,517,202 | A | 5/1996 | Patel et al. | |
| 6,058,874 | A | 5/2000 | Glenning et al. | |

FOREIGN PATENT DOCUMENTS

| | | |
|---|---|---|
| DE | 758461 | 1/1945 |
| DE | 2837134 | 3/1980 |
| DE | 3614225 C2 | 10/1987 |
| FR | 2748448 | 11/1997 |

OTHER PUBLICATIONS

AN/BRA-10 (http://www.fas.ortg/man/dod-101/sys/ship/weaps/an-bra-10.htm) Jun. 30, 1999.

(Continued)

*Primary Examiner*—Andrew D. Wright
(74) *Attorney, Agent, or Firm*—Jacox Meckstroth & Jenkins

(57) ABSTRACT

The mast device for a submarine comprises a guiding means, a vertically traversable mast guided therein and information means which are provided at the mast upper end and which are in electrical interaction with the inside of the submarine for emitting and receiving information. The information means are arranged in a buoyant unit held on the mast upper end without connection to this. The buoyant unit is fastened to a flexible coupling means which may be let out and retracted and which is of the length essentially of the maximum desired observation depth of the submarine.

14 Claims, 6 Drawing Sheets

OTHER PUBLICATIONS

AN/BRT-60 (http://www.fas.ortg/man/dod-101/sys/ship/weaps/an-brt-6.htm) Jun. 30, 1999.

AN/BSQ-5 (http://www.fas.ortg/man/dod-101/sys/ship/weaps/an-bsq-5.htm) Jun. 30, 1999.

* cited by examiner

MAST DEVICE FOR A SUBMARINE

CROSS-REFERENCE TO RELATED APPLICATION

This application is a continuation application of U.S. patent application Ser. No. 10/176,229 filed Jun. 20, 2002 now U.S. Pat. No. 6,907,839, which is incorporated herein by reference and made a part hereof.

BACKGROUND OF THE INVENTION

The invention concerns a mast device for a submarine.

Such a known mast device for submarines is provided such that at the upper end of the mast which is vertically traversable in a guiding means there is provided an information means which is in interactive connection with the control station in the inside of the submarine for receiving and emitting information. The information means is rigidly connected to the upper end of the mast and itself may be extended out by a certain amount so that it projects from the mast. If information is to be emitted and received, the submarine travels to the observation depth which corresponds to the height of the extended mast so that the information means is located above the water surface.

Furthermore it is known, e.g. by way of the DE patent document 758 461 and by way of DE 28 37 134 A1 to provide a buoyant unit in the form of a buoy which comprises an optical observation means. The buoy is releasably fastened to the body of the submarine, but via a cable which also transmits information signals to the command location, remains connected to this when the buoy is released from the submarine and on account of its intrinsic buoyancy has reached the surface of the water. The submarine is provided with a winch in order again to draw in the buoy after the end of its operation. The provision of an information buoy permits the submarine, in contrast to submarines with extending masts carrying information means, to assume a deeper observation depth position, in order to be able to carry out observations above the water surface. With these known buoy designs it is however disadvantageous that the main body of the submarine must additionally be specifically designed for the installation or accommodation of the buoyant buoy, which entails corresponding manufacturing costs and a larger space requirement.

BRIEF SUMMARY OF THE INVENTION

The object of the invention lies in further developing a mast device of the initially mentioned type such that in comparison to its extended condition, it permits a greater observation diving depth of the submarine for the information exchange above the water.

In one aspect, this invention comprises a mast device for a submarine, consisting of a guiding means, a vertically traversable mast guided thereon and information means which are provided at the mast upper end and which are in electrical interaction with the inside of the submarine for emitting and receiving information, wherein the information means are arranged in a buoyant unit held on the mast upper end without connection to this and wherein the buoyant unit is fastened to a flexible coupling means which may be let out and retracted and which is of the length essentially of the maximum desired observation depth of the submarine.

In another aspect, this invention comprises a method for increasing an observation diving depth of a submarine, comprising the steps of providing a buoyant unit comprising information means coupled to the submarine with a flexible coupling, releasing the buoyant unit from a mast when it is desired to communicate, letting out flexible coupling in a length that substantially corresponds to the observation diving depth.

In still another aspect, the invention comprises a mast device for a submarine, comprising a guide comprising a vertically traversable mast guided thereon and information means which are provided at an upper end of the mast and which are in electrical interaction with the inside of the submarine for emitting and receiving information, wherein the information means is arranged in a buoyant unit held on the mast upper end and wherein the buoyant unit is fastened to a flexible coupler which may be let out and retracted and which may be let out to a length essentially of the maximum desired observation depth of the submarine.

By way of the inventive design of the mast device it is possible for the submarine to be able to assume such a i.e. deeper observation diving depth which is greater than that of the merely extended mast device. A further advantage lies in the fact that a separate buoyant information unit additional to the mast device is done away with, from which there leads the further advantage that no special space or place on or in the submarine need be provided for a floatable information unit and thus also the manufacturing costs for a separate information unit and the design of a space for its positioning in the retracted condition are done away with. A further advantage of the inventive mast device lies in the fact that its information unit may also be used in a conventional manner for emitting and/or receiving information above the water surface, i.e., that the mast is extended but that the buoyant unit with the information means remains on the upper end of the mast.

In an advantageous embodiment of the inventive mast device the buoyant unit with the help of a seat formation in the upper mast region and with the help of the coupling medium is held secure in its position in the region of the upper end of the mast.

A further advantageous feature of the mast device lies in the fact that the mast upper end comprises a removable mast wall part for simplifying the release and repositioning of the buoyant unit from or on the mast upper end. Preferably the mast wall part is designed laterally pivotable, e.g. with the help of a piston-cylinder unit.

According to a further advantageous feature the coupling means which connects the buoyant unit to the mast consists of a cable, e.g. a wire cable or a carbon fibre cable. The coupling means may also contain for example the electrical signal leads for the signal transmission. Furthermore the coupling means by way of the winch may be let out of the mast and pulled in again.

Further advantageous embodiment forms of the mast device according to the invention are specified in the dependent claims.

BRIEF DESCRIPTION OF THE DRAWINGS

The invention is hereinafter described in more detail by way of two embodiment examples schematically represented in the accompanying\drawings. There are shown.

DETAILED DESCRIPTION OF THE INVENTION

Figures 1, 3:
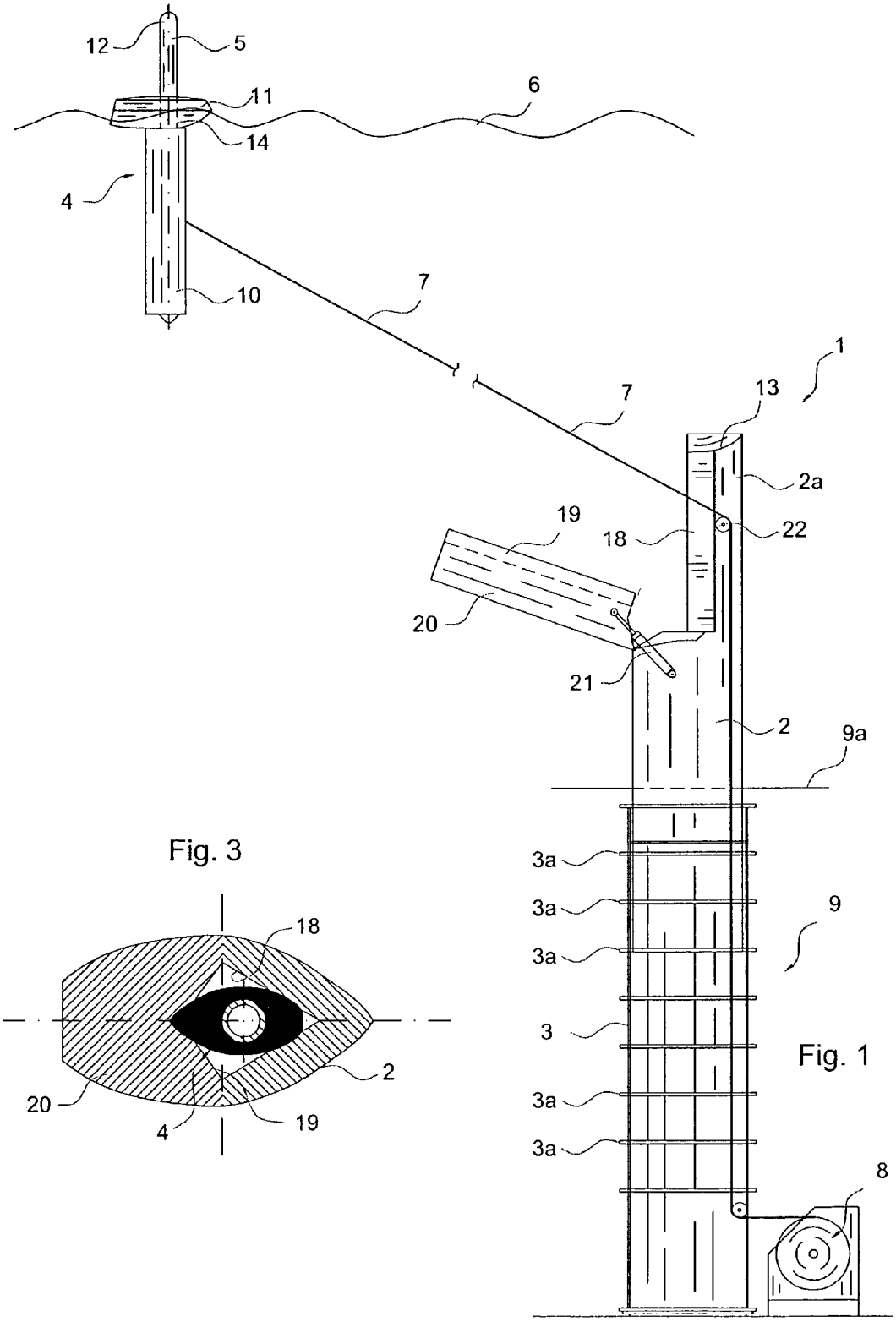
FIG. 1 a lateral view of the mast device with a buoyant unit situated in operation, FIG. 2 a lateral view of the mast device in the completely retracted position, FIG. 3 a cross section according to line II—II in FIG. 2, FIG. 4 the buoyant unit in a lateral view, FIG. 5 the buoyant unit in a front view, FIG. 6 a cross section according to line VI—VI in FIG. 4
Figure 9:
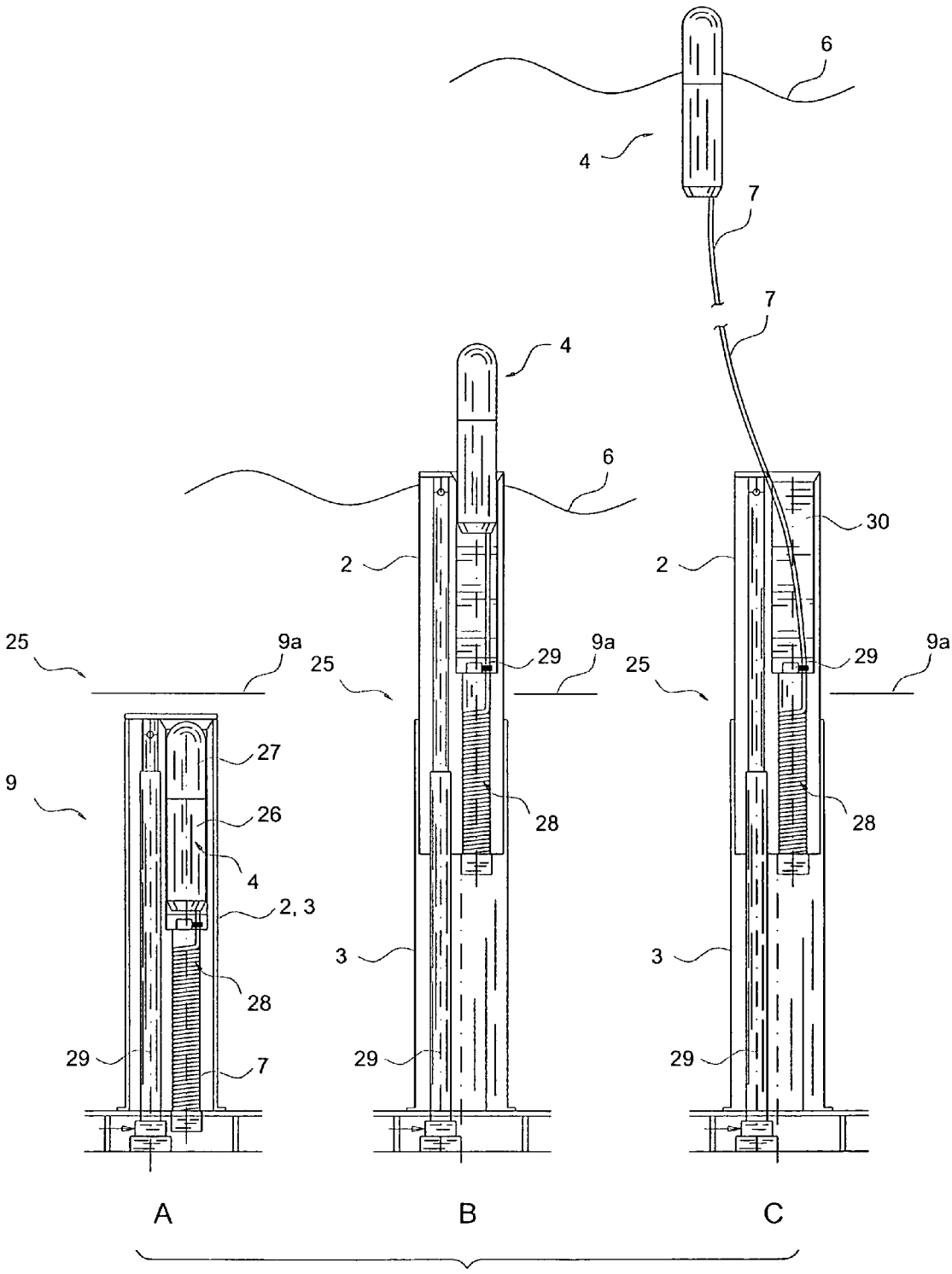

According to FIG. 1 the mast device indicated generally at 1 comprises a mast 2 which is vertically traversable in the conventional manner, a guide means 3 for the mast, a buoyant unit 4 with conventional information means 5 for emitting and/or receiving information of all types above the surface of the water, a flexible coupling means 7, preferably in the form of a wire cable or a carbon fibre cable, with which there may be combined signal leads for electrical signals to and from the information means 5, as well as a winch 8 for letting out and again drawing in the coupling means, in order to let the buoyant unit 4 rise to the surface of the water 6 or to retract it again from this. The winch 8 may be provided outside the guiding means 3, e.g. below next to it, or in the mast (FIG. 9). The mast 2 has according to FIG. 3 a hydrodynamic cross sectional profile and is vertically traversable in a conventional manner by way of a piston-cylinder unit (not shown), so that it may be extended out of the tower 9 of the submarine whose upper edge is indicated at 9*a*. The guiding means 3 is for example designed in the form of a shaft, which e.g. in the known manner may be manufactured of fibre composite material. The shaft-like guiding means 3 may be reinforced with ribs 3*a*. The guide means 3 which alternatively may also be designed in the form of columns extends essentially up to the upper edge 9*a* of the tower 9. The mast 2 is completely retractable into the shaft-like guiding means 3 so that it in this condition likewise does not project beyond the upper edge 9*a* of the tower 9.

Figure 2:
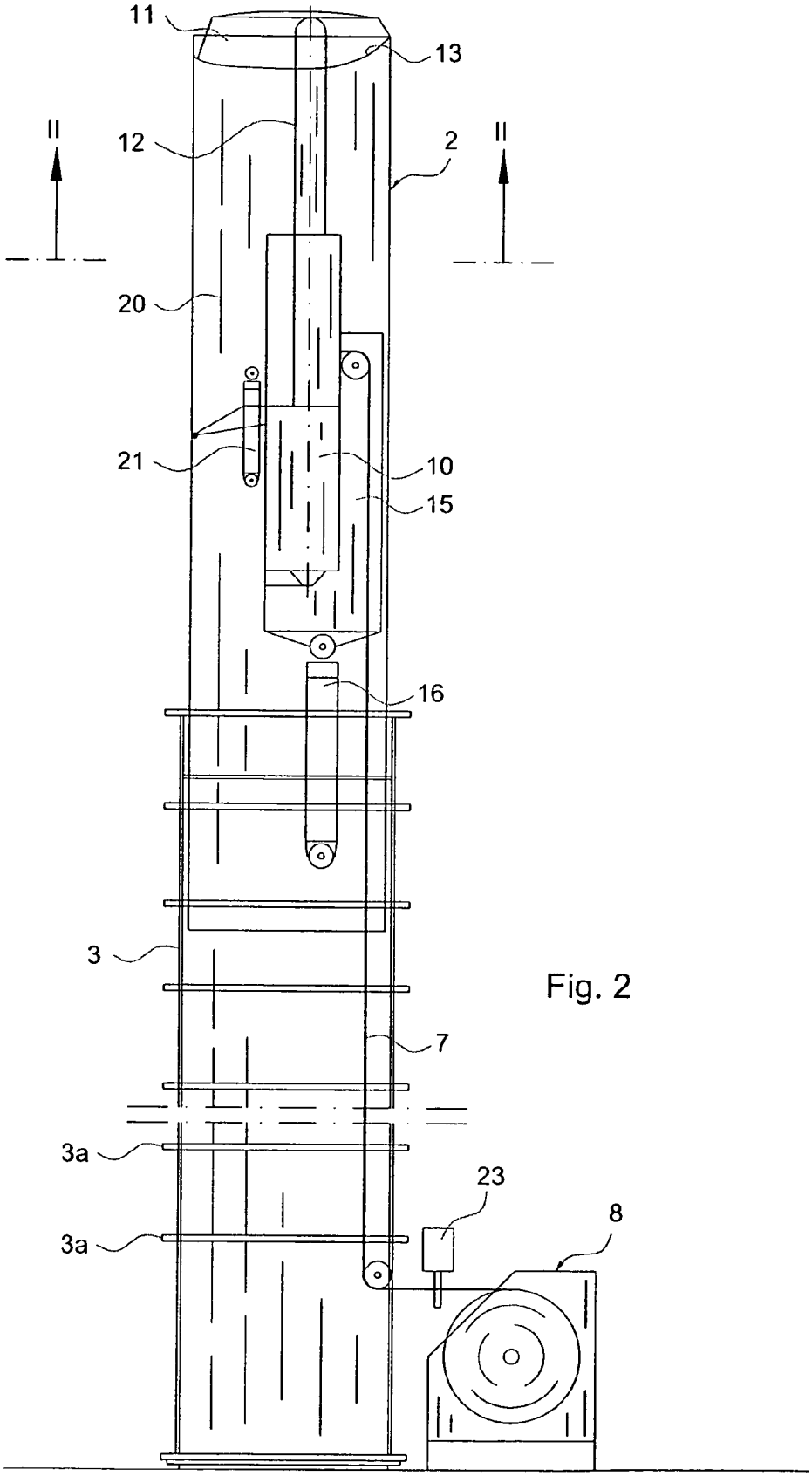

The buoyant unit 4 has an elongate floating body 10 which in the floating condition stands vertically, which effects a buoyancy force and which on its upper end comprises a platform 11 which with the unit 4 retracted closes the upper end of the mast 2. The information means 5, for example radar means, radio means and/or optical means are accommodated in the known manner in a housing 12 which in the operational position of the unit 4 is located above the platform 11. The housing 12 passes through the platform 11 roughly in the middle and is rigidly connected to the float body 10. In the case shown (FIG. 2) the float body 10 of the unit 4 is preferably separably connected to the platform 11. By way of this the float body 10 together with the housing 12 may be completely retracted into the mast whilst the platform 11 separates from the float body 10 and remains in a seat surface 13 at the upper end of the mast and by way of this closes the mast upper end in a lid function. The platform 11 thus comprises a passage 4 through which the housing 12 with the information means 5 may be moved.

The vertical movement of the float body 10 with the housing 12 of the buoyant unit 4 within the mast 2 is effected by way of a receiving means 15 which accommodates and grips the buoyant body 10, wherein the receiving means 15 is vertically traversable by way of a piston-cylinder unit 16.

Figure 4:
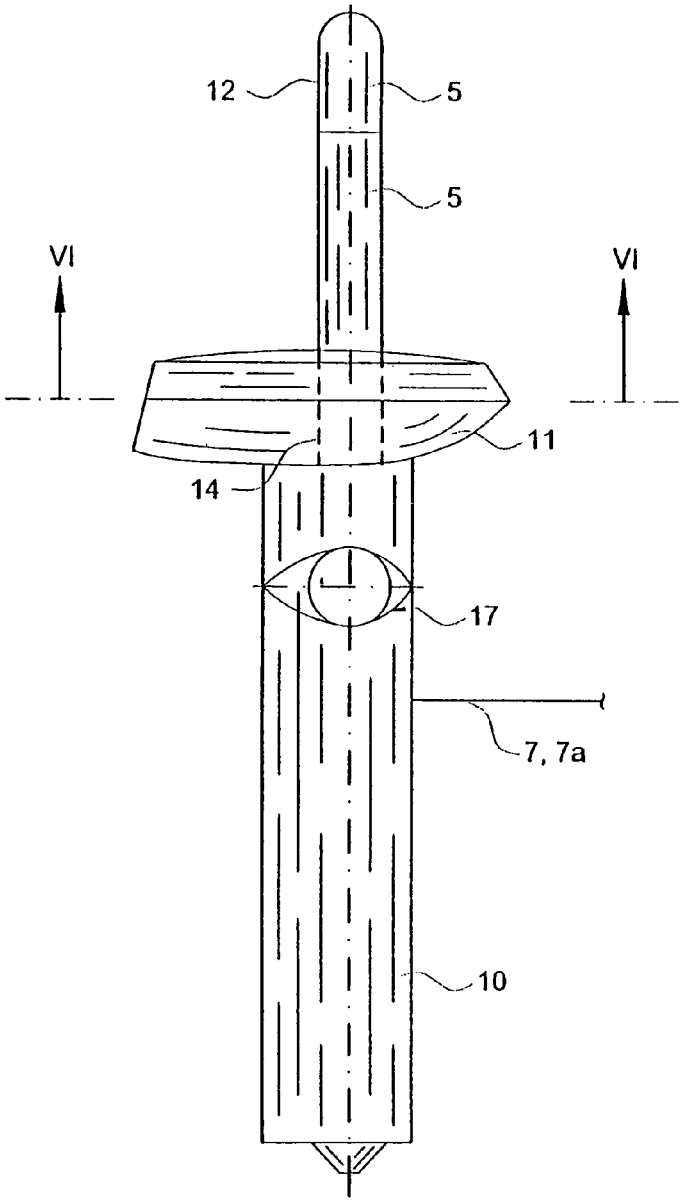
Figure 5:
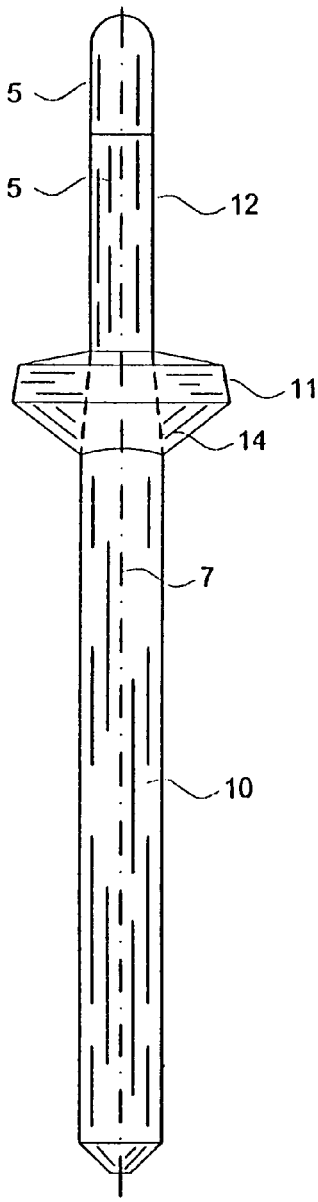
Figure 6:
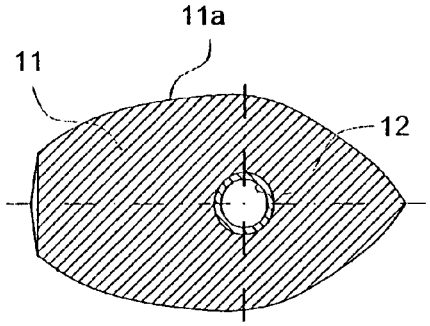

As is indicated in FIG. 4 with the arrow 17, the float body 10 in cross section is designed hydrodynamically in order to achieve a steady floating position of the unit 4. The coupling means 7 engages the floating body 10 at about half its height. The circumferential course 11 a of the platform 11 is adapted to the flow profile of the mast 2 (FIG. 3).

In the region of the upper end of the mast 2 there is provided a seat formation which apart from the seat surface 13 comprises two further seat surfaces 18 and 19 in order to position the buoyant unit 4 securely in the mast when it is retracted. In this condition it is held secure in position by way of the flexible coupling means 7 and the seat surfaces 13, 18 and 19.

In order to simplify the release of the buoyant unit and thus its floating to the surface of the water 6 when the flexible coupling means 7 is let out by way of the winch 8, i.e. is let out of the mast 2, and in order to simplify the repositioning of the unit 4 on the upper end of the mast when the coupling means 7 is pulled in by way of the winch 8, a mast wall part 20 at the upper end of the mast is designed removably replaceable again, preferably laterally pivotable, as FIG. 1 clearly shows. The lateral pivoting of the mast wall part 20 may be effected by way of a piston cylinder unit 21. The length of the pivotable mast wall part corresponds advantageously to the height of the float body 10 of the buoyant unit 4. In cross section the mast wall part 20 encompasses roughly half the periphery of the upper end of the mast as FIG. 3 clearly shows. In the region of the remaining rigid part 2*a* of the mast upper end there is provided a deflection roller 22 for the bendable coupling part 7. It can be understood that when the coupling part 7 is eased away the unit 4 may be easily released from the seat surfaces 18 and 13 and thus from the mast upper end when the mast wall part 20 is pivoted away. Reversely the unit without difficulty may again be positioned on the end of the mast on the seat surfaces 13, 18, 19 when the coupling part is drawn in.

From the above description it results that the buoyant unit 4 which is equipped with the usual information means for emitting and/or receiving information, is held free of connection on the mast upper end when it is located in the retracted condition. For raising the unit to the water surface 6 it is merely necessary to pivot away the mast wall part 20 and to let out the coupling part 7. On account of its intrinsic buoyancy the buoyant unit 4 then moves upwards to the surface of the water 6. The coupling means 7 is let out of the mast 2 according to the desired observation depth for the submarine desired in each case.

The mast device 2 may be provided with a cut-off means 23 in order to be able to sever the coupling means 7 in an emergency. In this case the unit 4 which has been let out and floats on the surface of the water 6 serves as an emergency buoy in order to draw attention to an emergency of the submarine. In the shown case the cut-off means 23 is provided outside the shaft-like guiding means 3 in the vicinity of the winch 8. However also other locations in the mast device 1 are considered.

Figure 7:
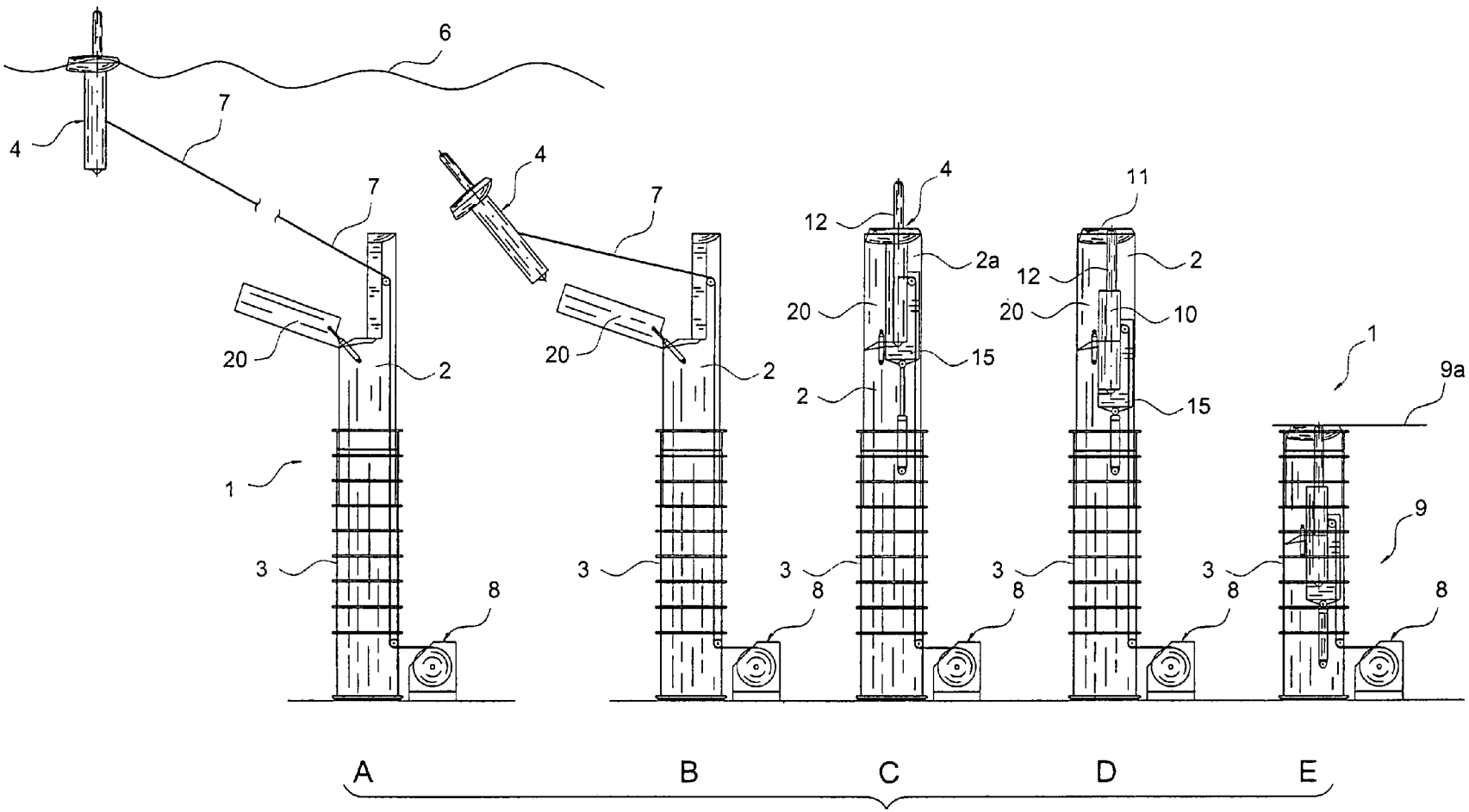
FIGS. 7*a–e* a representation of the mast device in various positions of extension, FIG. 8 a representation of the mast device, comparable to FIG. 1, supplemented with a stabilisations means for the buoyant unit, FIG. 9 a second embodiment example of the mast device in various positions of extension.

FIGS. 7*a* to 7*e* show the retraction procedure for the buoyant unit 4. According to FIG. 7*a* the unit 4 is located on the surface of the water 6. By way of actuation of the winch 8 the cable-like coupling means 7 and thus the unit 4 is retracted (FIG. 7*b*). After the coupling means has been retracted the mast wall part 20 is pivoted onto the stationary mast upper end 2*a* so that the unit 4 is seated on the upper end of the mast (FIG. 7*c*) without connection and in its correct position. Subsequently the float body 10 carrying the housing 12 with the information means is further retracted with the help of the receiving means 15 in a manner such that the housing no longer projects out of the platform 11 (FIG. 7*d*). Finally the mast is hydraulically retracted into the shaft-like guiding means 3 so that the mast no longer projects beyond the tower 9 of the submarine as can be clearly deduced from FIG. 7*e*. If the buoyant unit 4 is to reach the surface of the water 6, one proceeds in the reverse order.

Figure 8:
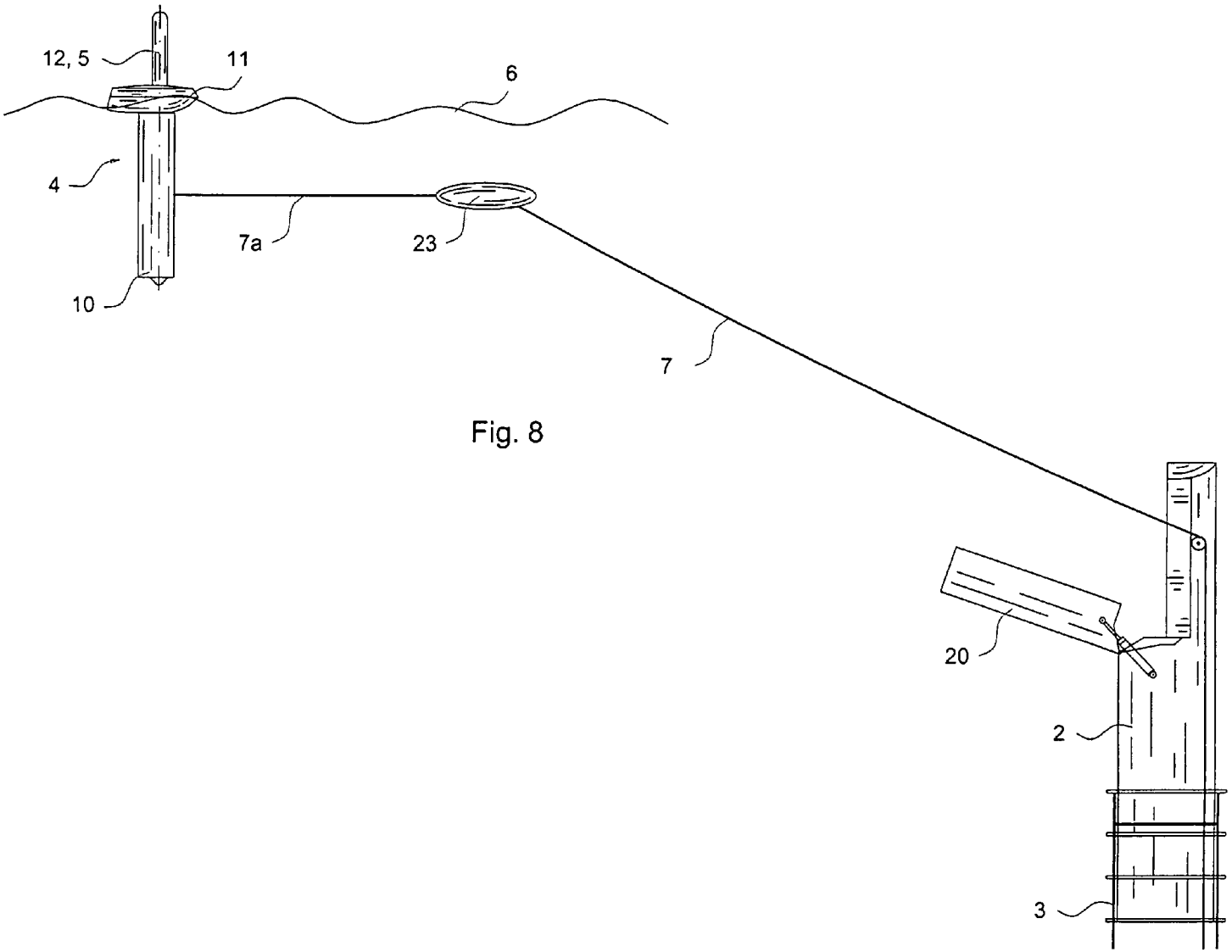

In order to ensure that the buoyant unit 4 in the water assumes a stabilised vertical attitude when the submarine is travelling during the emitting and/or receiving of information, the section 7*a* of the flexible coupling means 7, said section bordering the unit 4, is provided with at least one buoyancy means 23. This buoyancy means may consist of a hollow body or of a solid body of a buoyant material, e.g. foam. In place of a single buoyancy body 23 which may have a certain distance to the float body 10 of the unit 4, as FIG. 8 shows, one may proceed in that the section 7*a* is provided with a plurality of cylindrical or spherical buoyancy bodies which are centrally perforated and are set in row on the section 7*a*. Alternatively to this on the section 7*a* there may also be provided a rod-shaped buoyancy body with a central passage hole. Furthermore the design of the buoyancy body or bodies 23 is carried out such that they may be retracted into the mast 2 without trouble. The buoyancy force of each buoyancy body 23 is set such that the section 7*a* of the coupling means 2 assumes essentially a horizontal position when the submarine is travelling so that the floating unit 4 assumes a stabilised vertical position.

A second embodiment example of the mast device according to the invention is shown in FIG. 9 and is indicated generally at 25. This embodiment example is designed more simply than that of embodiment example 1. The buoyant unit 4 as a whole has a cylindrical shape whose lower region is designed as a float body, whist its upper region is designed as a water-tight housing in which the previously mentioned information means 5 is contained. Furthermore in the mast 2 there is provided a winch 28 on which the flexible coupling part 7 is wound. Furthermore also in this case there is provided a cut-off device 29 which is arranged in the mast 3. The mast 2 in the usual manner is vertically traversable in the shaft-like guiding means 3 by way of a piston cylinder unit 29 in a manner such that the mast may be extended up to its upper end position above the tower 9 of the submarine.

The mast 2 in the region of its upper end is designed with a tubular receiver 30 for the cylindrical, buoyant unit 4.

In FIG. 9 there is shown an extending procedure for the buoyant unit 4 of the mast device 25. FIG. 9*a* shows the mast device 25 including its buoyant unit in the complete retracted condition. The mast 2 and/or the floating unit 4 do not protrude upwards with respect to the upper edge 9*a* of the tower. FIG. 9*b* shows the mast 2 in the extended condition in a manner such that the upper end of the mast slightly projects beyond the surface of the water 6. In this position of the mast the buoyant unit 4 is partly extended in a manner such that it with its lower end is still located in the mast 2. Also in this operational position of the unit 4 information may be emitted and received. The observation depth of the submarine is in this case determined essentially by the extended mast 2. FIG. 9*c* shows the case in which the submarine is located at a considerably deeper observation depth with respect to the case according to FIG. 9*b*. In this case the coupling means 7 is wound off further from the winch 28 and projects out of the upper end of the mast 2 by the desired length, wherein the unit floats on the water surface 6 in a vertical position. From FIGS. 9*b* and 9*c* it becomes evident that the above described mast device may be used in the conventional operational position (FIG. 9*b*) and in an operational position with a considerably greater observation depth of the submarine (FIG. 9*c*). This both applies to the embodiment example 1 according to the FIGS. 1 to 8.

In both embodiment examples 1 and 25 the coupling means 7 has a total length which essentially corresponds to the maximum desired observation depth of the submarine.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. A mast device for a submarine, comprising a guiding means, a mast guided thereon and being vertically extendable and retractable into and out of a tower of the submarine and information means which are provided at the mast upper end and which are in electrical interaction with the inside of the submarine for emitting and receiving information, wherein the information means are arranged in a buoyant unit held on said upper end of said mast without connection to said upper end and wherein said buoyant unit is fastened to a flexible coupling means which may be let out and retracted and which is of the length essentially of the maximum desired observation depth of the submarine.

2. The mast device according to claim 1, wherein the buoyant unit with the help of a seat formation in the upper region of the mast and with the help of said flexible coupling means is held secure in position in the region of the mast upper end.

3. The mast device according to claim 1, wherein a winch is provided for letting out and again retracting said flexible coupling means.

4. The mast device according to claim 3, wherein said winch is provided in said mast or outside said guiding means of said mast.

5. The mast according to claim 1, wherein said buoyant unit comprises an elongated float body standing vertically in the floating condition.

6. The mast unit according to claim 5, wherein said elongated float body of said buoyant unit is designed hydrodynamically.

7. The mast device according to claim 1, wherein there is provided a cut-off means for said flexible coupling means.

8. The mast device according to claim 1, wherein said flexible coupling means in its section bordering the buoyant unit is provided with at least one buoyancy means for stabilising the vertical position of said buoyant unit when said buoyant unit is floating and said submarine is traveling.

9. The mast device according to claim 8, wherein said at least one buoyancy means consists of a hollow body or a buoyant solid body.

10. The mast device according to claim 1, wherein said flexible coupling means consists of a wire cable or of a carbon fibre cable.

11. The mast device according to claim 1, wherein said flexible coupling means is combined with signal leads for the signal transmission from and to the information means of said buoyant unit.

12. The mast device according to claim 1, wherein said guiding means is designed in the shape of a tubular shaft.

13. A method for increasing an observation diving depth of a submarine, comprising the steps of:

providing a buoyant unit comprising information means coupled to said submarine with a flexible coupling;

providing a mast that is vertically extendable and retractable into and out of the submarine; extending the mast out of the submarine;

releasing said buoyant unit from a mast when it is desired to communicate;

letting out said flexible coupling in a length that substantially corresponds to said observation diving depth.

14. A mast device for a submarine, comprising a guide comprising a vertically traversable mast guided thereon so that it is vertically extendable and retractable into and out of the submarine and information means which are provided at an upper end of the mast and which are in electrical interaction with the inside of the submarine for emitting and receiving information, wherein the information means is arranged in a buoyant unit held on the mast upper end and wherein the buoyant unit is fastened to a flexible coupler which may be let out and retracted and which may be let out to a length essentially of the maximum desired observation depth of the submarine; said buoyant unit being held on said upper end of said mast when it is not let out, being releasable from said upper end when it is let out, and being retractable back to said upper end when it is retracted.

* * * * *